United States Patent [19]

Bellows

[11] 4,383,572

[45] May 17, 1983

[54] FIRE DETECTION CLEANING ARRANGEMENT

[75] Inventor: Kenneth O. Bellows, Wellsville, N.Y.

[73] Assignee: The Air Preheater Company, Inc., Wellsville, N.Y.

[21] Appl. No.: 328,051

[22] Filed: Dec. 7, 1981

[51] Int. Cl.[3] ..... F28D 19/00; F28G 15/00

[52] U.S. Cl. ..... 165/5; 165/11 R; 250/338

[58] Field of Search ..... 165/5, 11 R; 250/338

[56] References Cited

U.S. PATENT DOCUMENTS 2,983,486 5/1961 Rosenberg ..... 165/5 X
4,019,567 4/1977 Wixson et al. ..... 165/5
4,022,270 5/1977 Stockman ..... 165/5
4,040,473 8/1977 Wheeler ..... 165/5

*Primary Examiner*—Albert W. Davis, Jr.
*Attorney, Agent, or Firm*—William W. Habelt

[57] ABSTRACT

An infrared ray sensing device for the rotor of a rotary rengenerative heat exchanger that includes a sensor 34 having a viewing lens 38 at the end of a moving support arm 36. The sensor is adapted to view the infrared ray emission from the rotor. As the arm moves along a path adjacent the rotor it comes into alignment with a fixed nozzle 44 that ejects a blast of cleaning fluid over the entire surface of the lens to remove dust deposits therefrom and thus maintain the lens in a clean condition.

10 Claims, 3 Drawing Figures

FIRE DETECTION CLEANING ARRANGEMENT

BACKGROUND OF THE INVENTION

In regenerative heat exchange apparatus, a mass of heat absorbent material commonly comprised of packed element plates is positioned in a hot exhaust gas passageway to absorb heat from the hot gases passing therethrough. After the plates become heated by the gas they are positioned in a passageway being traversed by cool air or other gas where the heated plates give up their heat to the cool air flowing therethrough. After the heat absorbent material has been repeatedly positioned in the hot exhaust gas passage it frequently becomes coated with soot and fly ash thereby rendering it subject to fires and lowering its overall effectiveness of the heat exchanger.

Instruments have been developed, including an infrared ray detector, that may be used to monitor the mass of heat absorbent material to detect an increase in output of infrared rays from the element mass, warn against incipient fires, and when necessary initiate fire control measures within the air preheater. U.S. Pat. Nos. 3,730,259 and 3,861,458 disclose apparatus that is positioned in an air stream facing a heat absorbent matrix therein to detect the infrared rays being emitted by the heated matrix of the heat exchanger. Typically, such instruments include viewing lenses which focus infrared rays given off by the element mass on to the detector.

Since the detection means, including the lens, must be constantly immersed in dust bearing gases, it rapidly becomes clouded or dirty so that it fails to transmit a maximum and true signal to the detector which as a consequence precludes obtaining a rapid and true indication of the temperature or other conditions within the preheater. The lens of such apparatus in continuous use soon becomes clouded so that it results in a loss of viewing efficiency, and then fails to react properly when an emergency occurs. Thus, the effectiveness of the fire detecting apparatus as defined herein is largely dependent upon maintaining a clean viewing lens therefor.

U.S. Pat. No. 4,040,473 discloses a method and apparatus for keeping the viewing lens clean. As disclosed therein, an annular channel surrounds the lens to permit a cleaning fluid to be supplied thereto and flow over the periphery of a lens to remove deposits therefrom.

Although such an application cleans the periphery of the lens well, it fails to remove deposits from the center of the lens. Moreover, it is economically expensive since all fluid lines must be enclosed within the device and they must be provided with expensive insulating features and with pivotal joints. Moreover, the lens holder itself must be made to exacting standards to include suitable duct work therein that results in excessive costs of manufacture and maintenance.

SUMMARY OF THE INVENTION

This invention therefore relates to an arrangement by which a sensor lens positioned continuously in a stream of gas may be maintained clean throughout a wide range of environmental conditions. More particularly, this invention relates to a simplified arrangement for exhausting a blast of cleaning fluid over the central portion of a lens in a fluid stream to remove deposits therefrom so the lens may more effectively sense the infrared rays being emitted from a "hotspot" within the rotor of a rotary regenerative air preheater.

DESCRIPTION OF THE PREFERRED EMBODIMENT

Figure 1:
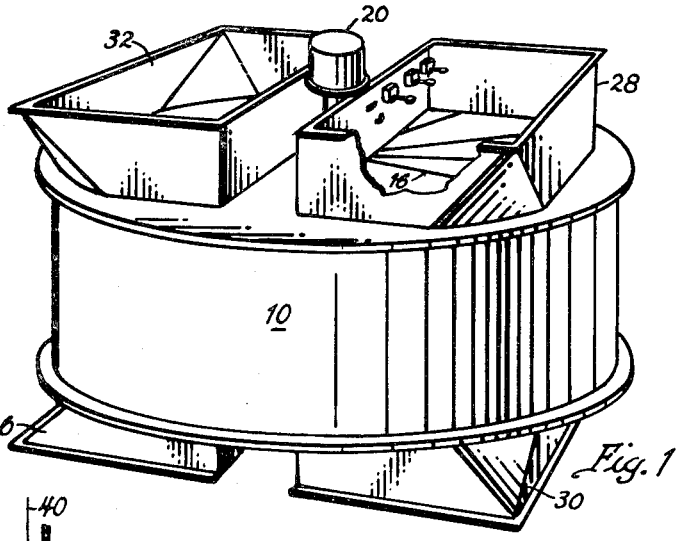
FIG. 1 is a perspective view of a rotary regenerative heat exchanger that includes apparatus of the invention.

Referring now to the drawing, there is depicted therein a rotary regenerative air preheater comprising a cylindrical housing 10 that encloses a rotor having a cylindrical casing that includes a series of compartments formed by radial partitions 16 extending between the casing and a central rotor post. The compartments each contain a mass of heat absorbent material 17 in the form of corrugated plates or the like that provide passageways for the flow of fluid therebetween.

The rotor is rotated slowly about its axis by a motor 20 to advance the heat absorbent material contained by the compartments of the rotor alternately between a heating fluid and a fluid to be heated. The heat absorbent material 17 absorbs heat from a heating fluid entering duct 26 of the heat exchanger, and then transmits the absorbed heat to a cooler fluid entering the heat exchanger through a duct 28. After passing over the hot heat exchange material and absorbing heat therefrom, the heat fluid is discharged through duct 30 to a boiler furnace or other place of use while the cooled fluid is discharged through a duct 32.

Instrument means including a sensor head 34 have been developed to detect the radiation of infrared rays from the heat absorbent element 17 as a prerequisite for detecting incipient fires and initiating fire control measures within the rotor of the preheater. A viewing lens 38 on the sensor is adapted to view a potential source of fire and focus the infrared rays emitted thereby onto the sensor or detector. The rays are then translated into an electrical impulse that is transmitted over suitable circuitry 40 to an indicator or control device where remedial measures are initiated.

Figure 2:
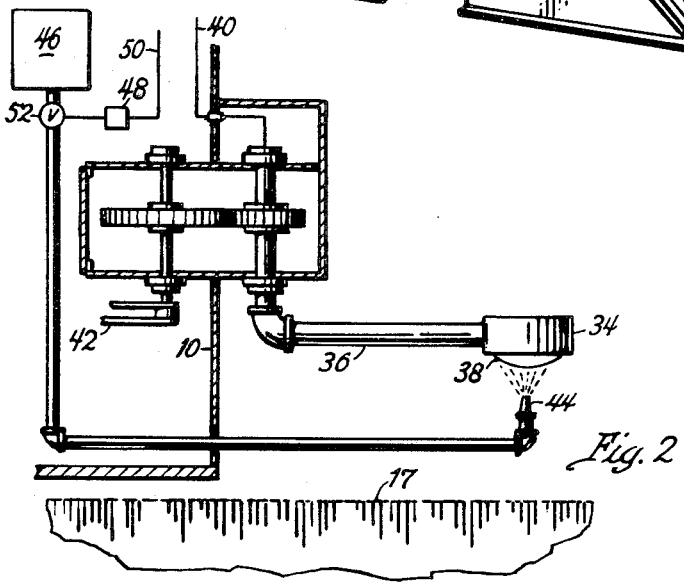
FIG. 2 is an enlarged sectional view showing the relationship of a fixed nozzle means to the sensor head wherein the sensor head moves along an arcuate path.
Figure 3:
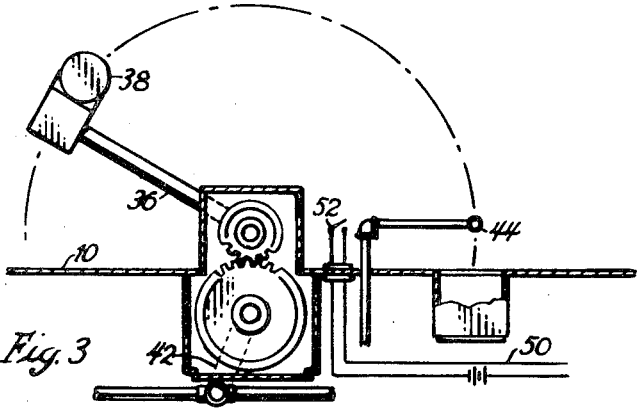
FIG. 3 is an enlarged top plan view taken along line 3—3 of FIG. 2.

One or more sensor heads traverse the duct 28 in a plane parallel and adjacent the end of rotor 16 so that the entire surface of the end face of the rotor 16 is viewed as the rotor rotates through the duct 28. Although the sensor head may be reciprocated in and out of the rotor shell so as to translate across the duct 28, it is most common in the art to pivot the sensor heads 34 so that the sensor lens 38 moves along an arcuate path as illustrated in FIGS. 2 and 3. It should be noted, however, that the specific means and method by which the sensor head traverses duct 28 is not germane to the invention per se. The embodiment of an arcuately traveling sensor head, as shown in FIGS. 2 and 3, is set forth for the purpose of fulfilling the best mode requirements of 35 USC 112.

In order to maintain the lens at or near its peak of light transmission capability the lens is periodically subjected to a cleaning process that removes deposits of dust therefrom and thus maintains the lens in a virtually dust-free condition. According to the present invention, there is provided a fixed nozzle 44 that is adapted to continuously face a segment of the path being traversed by the lens 38 on the sensor head 34. As the sensor head 34 traverses its path and the lens 38 comes into direct alignment with nozzle 44, a source 46 is timed to eject a blast of pressurized cleaning fluid from the nozzle over the lens to remove deposits therefrom.

As illustrated in FIGS. 2 and 3, the arms 36 are arcuately moved by apparatus such as a reciprocating driving arm 42 rotating conventional gearing that in turn pivots the arm 36 carrying the sensing device. The specific apparatus used for actuating arm 42 of the device disclosed is not germane to the invention itself and may, for convenience, be considered as any conventional prime mover.

The flow of cleaning fluid to nozzle 44 is controlled by an arrangement not limited to but illustrated as a conductor 50 leading to actuator 48 for valve 52 that controls the flow of cleaning fluid from source 46 to the nozzle 44. The conductor 50 leads to a switch diagrammatically illustrated at 52 that is actuated by movement of arm 36 into contact therewith. Other equivalent actuating means such as a timer, photo-electric cell, or an indexing means activated by alignment of the sensor and nozzle may be used without departing from the scope and spirit of the invention.

The blast of cleaning fluid exhausting from nozzle 44 over the lens 38 is adapted to directly confront the entire surface of the lens. Consequently all dust deposits are immediately removed by the blast of cleaning fluid from nozzle 44 and the infrared rays emanating from a "hot-spot" in element 17 traverse the lens freely to make a maximum impact upon sensor 34.

I claim:

1. Heat exchange apparatus including a housing having inlet and outlet ducts for a heating fluid and for a fluid to be heated, a cylindrical rotor of heat absorbent material in said housing mounted for rotation about the central axis of the rotor, means for rotating the rotor to alternately subject the heat absorbent material thereof to the heating fluid and to the fluid to be heated, infrared ray detecting means including a sensor having a lens that confronts the heat absorbent material of the rotor, a support arm supporting the sensor, means moving the sensor support arm along a path in a plane parallel to and adjacent the end of the rotor, a source of pressurized cleaning fluid, fixed nozzle means adapted to confront said lens as the sensor traverses a portion of its path adjacent the end of the rotor, and means for exhausting a blast of cleaning fluid from said source through the fixed nozzle to impinge upon the surface of the lens as it confronts the nozzle whereby dust deposits on said lens are removed therefrom.

2. Heat exchange apparatus having an infrared ray detecting means as defined in claim 1 wherein the means for exhausting a blast of cleaning fluid over the lens comprises switching means actuated by the moving sensor support arm.

3. Heat exchange apparatus having an infrared ray detecting means as defined in claim 2 wherein said fixed nozzle means lies adjacent the inlet duct for the fluid to be heated.

4. Heat exchange apparatus having an infrared ray detecting means as defined in claim 3 wherein the fixed nozzle means lies normal to the horizontal axis of said sensor lens to exhaust cleaning fluid from said nozzle substantially normal to the horizontal axis of said lens.

5. Heat exchange apparatus having an infrared ray detecting means as defined in claim 4 wherein the path of the sensor intersects the central axis of said nozzle whereby cleaning fluid exhausting from said nozzle impinge upon the central portion of said lens.

6. Heat exchange apparatus including a housing having inlet and outlet ducts for a heating fluid and for a fluid to be heated, a cylindrical rotor of heat absorbent material in said housing mounted for rotation about the central axis of the rotor, means for rotating the rotor to alternately subject the heat absorbent material thereof to the heating fluid and to the fluid to be heated, infrared ray detecting means including a sensor having a lens that confronts the heat absorbent material of the rotor, a pivotal arm supporting the sensor, means moving the pivotal arm arcuately in a plane parallel to and adjacent the end of the rotor, a source of pressurized cleaning fluid, fixed nozzle means adapted to confront said lens as the pivotal arm traverses a portion of its arcuate path adjacent the end of the rotor, and means for exhausting a blast of cleaning fluid from said source through the fixed nozzle to impinge upon the surface of the lens as it confronts the nozzle whereby dust deposits on said lens are removed therefrom.

7. Heat exchange apparatus having an infrared ray detecting means as defined in claim 6 wherein the means for exhausting a blast of cleaning fluid over the lens comprises switching means actuated by the arcuately moving pivotal arm.

8. Heat exchange apparatus having an infrared ray detecting means as defined in claim 7 wherein said fixed nozzle means lies adjacent the inlet duct for the fluid to be heated.

9. Heat exchange apparatus having an infrared ray detecting means as defined in claim 8 wherein the fixed nozzle means lies normal to the horizontal axis of said sensor lens to exhaust cleaning fluid from said nozzle substantially normal to the horizontal axis of said lens.

10. Heat exchange apparatus having an infrared ray detecting means as defined in claim 9 wherein the arcuate path of the sensor intersects the central axis of said nozzle whereby cleaning fluid exhausting from said nozzle impinge upon the central portion of said lens.

* * * * *